United States Patent [19]

Odawara et al.

[11] 4,014,711

[45] Mar. 29, 1977

[54] SEPARATION OF FRUCTOSE FROM A MIXTURE OF SUGARS

[75] Inventors: Hiroyuki Odawara; Yoshio Noguchi; Masaji Ohno, all of Kamakura, Japan

[73] Assignee: Toray Industries, Inc., Tokyo, Japan

[22] Filed: Feb. 18, 1976

[21] Appl. No.: 658,910

[30] Foreign Application Priority Data

Feb. 21, 1975 Japan ..... 50-20892

[52] U.S. Cl. ..... 127/46 B; 127/46 R

[51] Int. Cl.[2] ..... C13D 3/12; C13K 3/00; C13K 11/00

[58] Field of Search ..... 127/46 A, 46 B, 46 R, 127/41; 210/24, 31 C

[56] References Cited

UNITED STATES PATENTS

| | | | |
|---|---|---|---|
| 2,522,022 | 9/1950 | Durant | 127/46 A |
| 2,522,797 | 9/1950 | Paley | 127/46 A |
| 3,044,904 | 7/1962 | Serbia | 127/46 R |
| 3,044,905 | 7/1962 | Lefevre | 127/46 R |
| 3,416,961 | 12/1968 | Mountfort | 127/46 A X |
| 3,483,031 | 12/1969 | Lauer | 127/46 R X |
| 3,666,647 | 5/1972 | Kubo | 127/46 R X |
| 3,671,316 | 6/1972 | Tatuki | 127/46 R |
| 3,692,582 | 9/1972 | Melaja | 127/46 A |
| 3,784,409 | 1/1974 | Nelson | 127/46 A |
| 3,785,864 | 1/1974 | Lauer | 127/46 A |
| 3,806,363 | 4/1974 | Takasaki | 127/46 A |
| 3,864,166 | 2/1975 | Barker | 127/46 R |

*Primary Examiner*—Joseph Scovronek
*Assistant Examiner*—Sidney Marantz

[57] ABSTRACT

Fructose is effectively separated from a mixture of sugars by contacting an aqueous solution of a mixture of sugars with crystalline alumino-silicate.

9 Claims, 5 Drawing Figures

SEPARATION OF FRUCTOSE FROM A MIXTURE OF SUGARS

BACKGROUND OF THE INVENTION

1. Field of the Invention

The present invention relates to a method for separating fructose from a mixture of sugars, wherein certain solid adsorbents are used as separating media.

2. Description of the Prior Art

Fructose is the sweetest of all the sugars present in nature and has been known to be useful dietetically as the most ideal sugar. However, no economical method available of manufacturing fructose has been made available at present. Fructose, consequently, has been an expensive commodity and has found only limited use as a high-grade sweetener.

Various methods have been investigated and proposed for the individual separation of glucose and fructose from mixtures containing sugars.

Examples of these methods are: (1) separating fructose from glucose by converting fructose into a calcium-fructose complex by treatment with calcium hydroxide or calcium chloride; (2) effecting the desired separation by using a cation-exchange resin bed such as the calcium form (U.S. Pat. No. 3,044,904), the strontium form (U.S. Pat. No. 3,044,905), the silver form (U.S. Pat. No. 3,044,906) and the hydrazine form (U.S. Pat. No. 3,471,329); (3) effecting the desired separation by using anion-exchange resin beds such as the borate form (U.S. Pat. No. 2,818,851) and the bisulfite form (U.S. Pat. No. 3,806,363); (4) and other sophisticated methods (U.S. Pat. No. 3,050,444).

Among the methods proposed to date, the calcium method has been adopted for commercial operation and the bisulfite anion-exchange resin method is claimed to be promising. Nevertheless, the former method is batchwise in nature and not totally economical for large scale production, and the latter method requires a large amount of resin and is confronted with the serious problem of resin deterioration.

An object of this invention is to provide an economical method for separating fructose from a mixture of sugars containing fructose and glucose.

Other objects and characteristic features of this invention will become apparent from the further description appearing hereinafter.

DETAILED DESCRIPTION OF THE INVENTION

It has now been discovered that fructose of high purity can be separated very effectively and economically from a sugar solution containing fructose and glucose or from an inexpensive raw material containing contaminants in addition to glucose and fructose, by the application of crystalline alumino-silicate as the separating media.

Crystalline alumino-silicate or zeolite is generally used as a dehydration agent for drying gases and organic liquid substances.

We have surprisingly found that zeolite adsorbs fructose more strongly than other sugars such as glucose or other oligosaccharides, even in aqueous solution. Such selective adsorption of sugars by crystalline alumino-silicate is beyond the usual expectation, since fructose and glucose are isomers of the same molecular weight.

Crystalline alumino-silicates which find use as adsorbents in the present invention are represented by the formula: $(M_{2/n}O)x \cdot (Al_2O_3)y \cdot (SiO_2)z\ {}^{(H}{}_2O)w$ wherein M is a cation, $n$ is the valence of the cation, and $x$, $y$, $z$ and $w$ are respectively mole numbers. Both synthetic and natural alumino-silicates can be used in the present invention. However, alumino-silicates having an average pore diameter smaller than about 5A have been found to be inadequate to completely separate fructose. In other words, the crystalline alumino-silicates used in the present invention are required to have an average pore diameter larger than about 5A to effect practical separation of fructose from a sugar mixture of fructose, glucose and other contaminating substances. The maximum pore diameter is about 15A.

Various types of alumino-silicates having an average pore diameter larger than about 5A may be essentially used as adsorbents. However, crystalline alumino-silicates in the form of faujasite type X, Y and L, in the form of mordenite, are preferably used. The exchangeable cationic sites for the crystalline alumino-silicates represented as M in the above formula are preferably composed of the following metal cations: lithium, sodium, potassium and cesium among the alkali metals, and beryllium, magnesium, calcium, strontium and barium among the alkali earth metals. The latter alkali earth metals are most favorably utilized as the cation. However, other metal cations including copper, silver, zinc, cadmium, aluminum, lead, iron and cobalt can also be used. Further, ammonium ($NH_4$+), methylammonium ($CH_3NH_3$+), and hydrogen ion ($H^+$) can be used. These cations can be used individually or mixed.

The substitution of the metal cation M defined above may be effected by conventional ion exchange methods. Usually, this substitution is performed by contacting a crystalline alumino-silicate with an aqueous solution of a soluble salt of the metal desired to be substituted.

The aquous solution may be applied separately, or as a mixed solution. For instance, the sodium ion of the faujasite-type crystalline alumino-silicate may be treated with a 1 N. aqueous solution of a metal salt of nitric acid at 60° C for 2 hours. Such operation is usually repeated several times to complete the substitution and the alumino-silicate thus obtained is washed well with distilled water.

Although such alumino-silicate can be used directly for separation of fructose in accordance with the present invention, it is more preferably used after drying at an elevated temperature. Such an alumino-silicate can be used in powder form, pellet form or other form.

According to the present invention, it is desirable to separate the fructose from the mixture of sugars in the liquid phase.

Water is most preferable as a solvent for the sugars, from the point of view of solubility and safety. In this case, alcohol or other solvent can be added to a certain extent, if necessary or desired.

The mixture of sugars that may be used as the feed stock essentially contains fructose and glucose and may contain minor amounts of starch, oligosaccharides or other sugars in addition to the fructose and the glucose. The preferred feed stocks are fructose syrup obtained from isomerization of glucose by enzyme-catalyzed reaction, or by acid- or base-catalyzed reaction and those obtained from sucrose by acid-hydrolysis. The above fructose-containing glucose isomerized syrup may contain oligosaccharides including disaccharides and contaminating substances, or may contain maltose, mannose and/or psicose as contaminating substances.

The sugar solution to be introduced into the adsorption zone is desired to have a high concentration of about 10 to 80% by weight, preferably about 20 to 70% by weight. The adsorption temperature ranges from about 10° C to about 100° C. However, higher temperatures are not favorable because of thermal decomposition of fructose. Usually, the separation of fructose is preferably carried out at about 10° to 50° C by considering the viscosity of the solution and its adsorption rate.

Selection of a suitable desorbent is also important because it not only affects the cost of separation but also safety of the product. It has been surprisingly found that water itself is an ideal desorbent for the separation of fructose from a mixture of fructose, glucose, and contaminating substances. Accordingly, both adsorption and desorption are preferably performed in liquid phase operations by using water. The process of this invention makes possible the complete separation of fructose from a mixture of fructose, glucose and other contaminating substances. Thus, separation of fructose can be applied by using any general technique or method of adsorption-separation such as fixed bed, fluid bed, or moving bed operation.

DRAWINGS

The following descriptive examples are given as illustrations and are not intended to constitute limitations of the scope of the invention.

EXAMPLE 1

One hundred grams of crystalline barium alumino-silicate (Y-Ba), prepared from sodium zeolite in the form of a faujasite-type Y, by ion exchange (ion exchange rate = 100%; granule diameter = 20 to 40 mesh) was packed in a 15mm internal diameter column and the column was filled with water.

Figure 1:
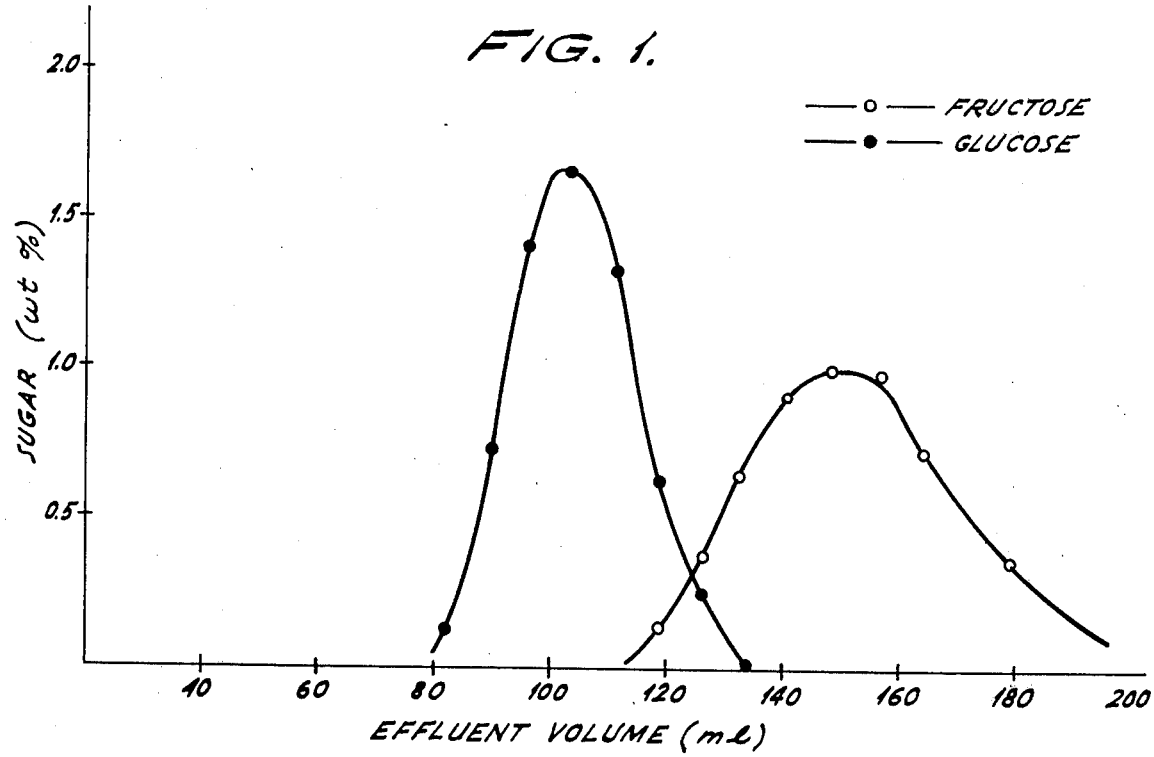
FIG. 1 is a graph showing the state of separation of glucose and fructose from a mixture containing the said sugars by using a crystalline barium alumino-silicate in the form of a faujasite-type Y zeolite.

An aqueous solution of 0.5g of glucose and 0.5g of fructose dissolved in 1 ml of water was introduced at the top of the column and the adsorbed sugars were eluted with water. The zeolite column was maintained at room temperature during the separation, and the flow rate was kept at 33 ml/hr. The effluent was collected into fractions of constant volume (1.5 ml). Each fraction was subjected to analysis to determine the content of glucose and fructose. The results are shown in FIG. 1 of the drawings. As clearly shown in FIG. 1, glucose was eluted first and then fructose (fractions of 130 to 200 ml) was eluted, demonstrating that clear separation of fructose and glucose was effectively achieved.

EXAMPLE 2

One hundred grams of crystalline calcium alumino-silicate (Y-Ca) prepared from sodium zeolite (faujasite-type Y) by ion exchange (exchange rate = 85%; granule diameter = 20 to 40 mesh), was packed in a 15 mm internal diameter column and the column was filled with water.

An aqueous solution of 0.5g of glucose and 0.5g of fructose dissolved in 1 ml of water was introduced at the top of the column and the adsorbed sugars were eluted with water. The zeolite column was maintained at room temperature during the separation procedure, and the flow rate was kept at 33 ml/hr. The effluent was collected into fractions of a constant volume 1.5 ml). Each fraction was subjected to analysis to determine the content of glucose and fructose. The results are shown in FIG. 2.

Figure 2:
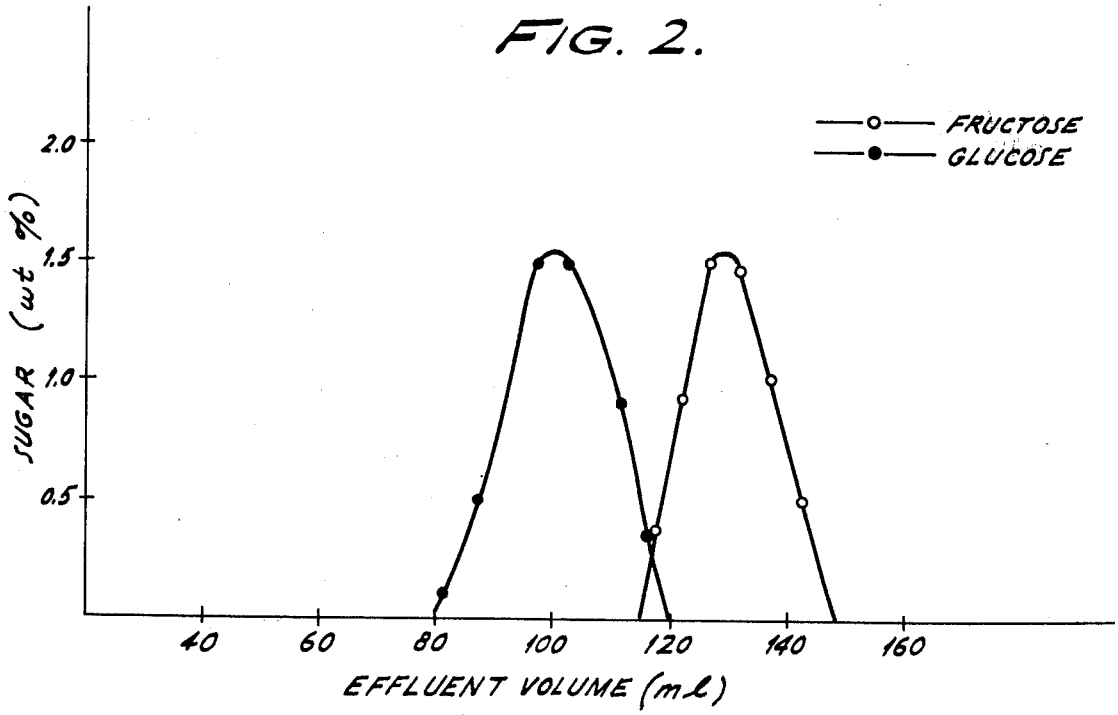
FIG. 2 is a graph showing the state of separation of glucose and fructose from a mixture containing the said sugars by using a crystalline calcium alumino-silicate in the form of a faujasite-type Y zeolite.

As shown in FIG. 2, glucose was eluted first and then fructose (fractions of 115 to 160 ml) was eluted, indicating that separation of fructose and glucose was effectively achieved.

EXAMPLE 3

One hundred grams of crystalline strontium alumino-silicate (Y-Sr), prepared from sodium zeolite of the faujasite Y-type by ion exchange (ion exchange rate = 90%; granule diameter = 20 to 40 mesh), was packed into a column of 15 mm internal diameter and the column was filled with water.

An aqueous solution of glucose (0.5g) and fructose (0.5g) dissolved in 1 ml of water was introduced at the top of the column and the adsorbed sugars were eluted with water at room temperature. The flow rate was kept at 33 ml/hr. The effluent of each fraction was assayed for fructose and glucose content. The results are shown in FIG. 3.

Figure 3:
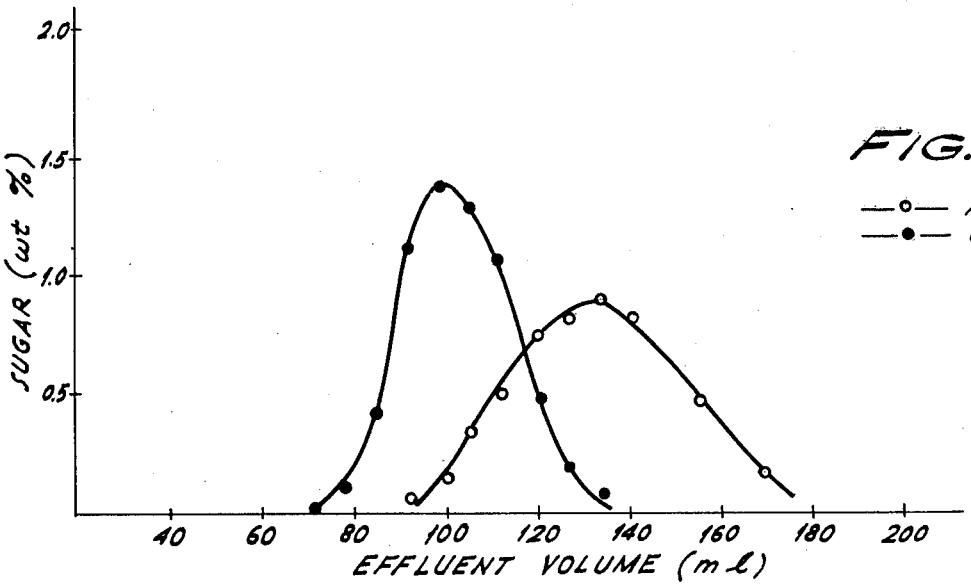
FIG. 3 is a graph showing the state of separation of glucose and fructose from a mixture containing the said sugars by using a crystalline strontium alumino-silicate in the form of a faujasite-type Y zeolite.

As is clearly shown in FIG. 3, the glucose was eluted first and then the fructose (fractions of 140 to 180 ml) was eluted, demonstrating that separation of fructose and glucose was effectively carried out.

EXAMPLE 4

One hundred grams of the same slid-adsorbent (Y-Ba) used in Example 1 was packed into a column having an internal diameter of 15 mm, and the column was filled with water. Glucose-isomerized syrup (1.2 ml) containing 50% of glucose, 42% of fructose, and 8% of oligosaccharides was placed at the top of the column and the adsorbed sugars were eluted with water under the same condition as in Example 1.

It was shown that glucose and oligosaccharides were eluted first, almost in the same fractions and then fructose was separately eluded (fractions 140 to 200 ml). The separation was found to be excellent.

EXAMPLE 5

Separation of fructose from a mixture of fructose and glucose was carried out using a zeolite comprising a crystalline potassium alumino-silicate (Y-K), of the faujasite Y type under the same experimental conditions as described in Example 1.

Figure 4:
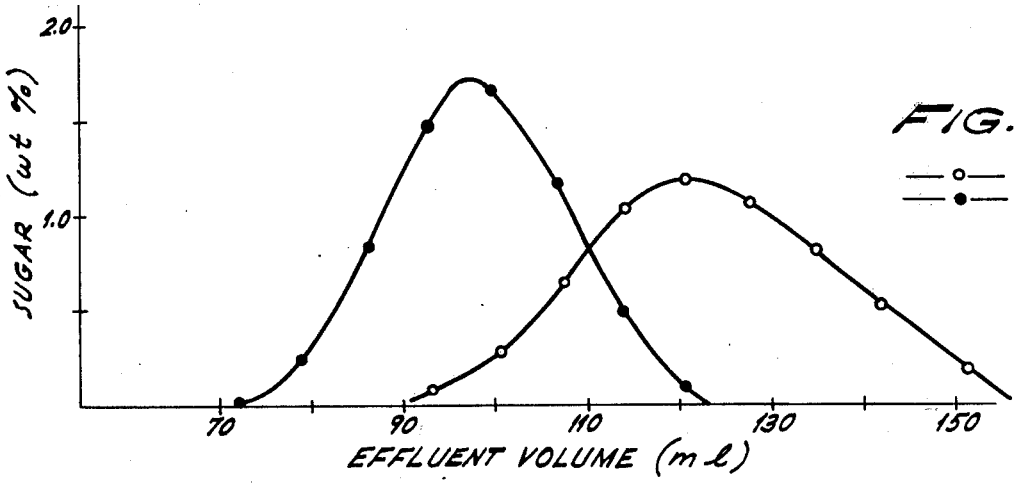
FIG. 4 is a graph showing the state of separation of glucose nd fructose from a mixture containing the said sugars by using a crystalline potassium alumino-silicate in the form of a faujasite-type Y zeolite.

The results are shown in FIG. 4. Glucose was eluted in the beginning fractions and fructose was collected at fractions of 120 to 165 ml.

EXAMPLE 6

One hundred grams of crystalline barium alumino-silicate (X-Ba) prepared from faujasite-type X by ion exchange, was packed in a column having an internal diameter of 15 mm, and elution with water was carried out under the same experimental conditions as described in Example 1.

Figure 5:
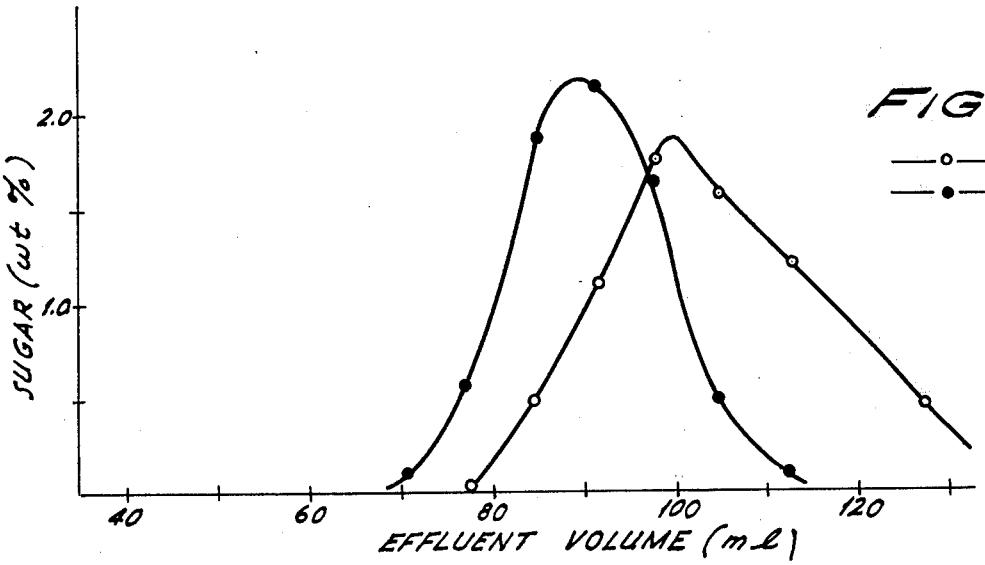
FIG. 5 is a graph showing the state of separation of glucose and fructose from a mixture containing the said sugars by using a crystalline barium alumino-silicate in the form of a substituted X type faujasite crystalline zeolite.

The results are shown in FIG. 5. Glucose was found to be more easily eluted with water than fructose.

EXAMPLE 7

Separation of fructose from a mixture of fructose and glucose was carried out using crystalline sodium alumino-silicate (Y-Na) of the faujasite-type Y under the same conditions as described in Example 1. The results clearly showed that glucose was first eluted and fructose was eluted successively.

EXAMPLE 8

Fructose was separated using crystalline sodium alumino-silicate (X-Na) of the faujasite-X type. The other conditions of operation were the same as described in Example 1. The effluence from the column occurred first on glucose, and then on fructose.

EXAMPLE 9

Fructose was separated from the glucose isomerized syrup containing 50% of glucose, 42% of fructose and 8% of oligosaccharides, using crystalline potassium alumino-silicate (Y-K) of faujasite-Y type as the adsorbent.

The other conditions of operation were the same as outlined in Example 1.

The effluence from the column occurred first on the oligosaccharides and on the glucose, and then on the fructose.

EXAMPLE 10

Fructose was separated using "Zeolon 900" in the form of mordenite type crystalline sodium alumino-silicate as the adsorbent. The other conditions of operation were the same as outlined in Example 1.

The effluence from the column occurred first on glucose, and then on fructose.

EXAMPLE 11

(Comparative Example)

Fructose was separated from a solution containing glucose and fructose using crystalline sodium alumino-silicate (A-Na) of type A which had a pore diameter of 4A. The other conditions of operation were the same as outlined in Example 1.

The effluence from the column occurred on glucose and fructose simultaneously, demonstrating that no significant separation of fructose and glucose was obtained.

We claim:

1. A method for separation of fructose from a mixture of sugars essentially containing fructose and glucose, which method comprises contacting an aqueous solution of said mixture of sugars with crystalline alumino-silicate having an average pore diameter greater than about 5 A, desorbing the adsorbed sugars with water and separating the fructose-rich fraction obtained.

2. The method according to claim 1, in which said crystalline alumino-silicate is faujasite type selected from the group consisting of X, Y and L.

3. The method according to claim 1, in which said crystalline alumino-silicate is mordenite.

4. The method according to claim 1, in which said crystalline alumino-silicate has at least one metal cation selected from the group consisting of alkali metal, alkali earth metal, copper, silver, zinc, cadmium, aluminum, lead, iron and cobalt.

5. The method according to claim 1, in which the total sugar concentration of said feed aqueous solution is between about 10 and 80 weight percent.

6. The method according to claim 1, in which the separation of fructose is carried out at a temperature of about 10° to 60° C.

7. The method according to claim 1, in which said mixture of sugars is a high fructose syrup obtained from isomerization of glucose.

8. The method according to claim 1, in which said mixture of sugars is obtained by hydrolysis of sucrose.

9. The method according to claim 1, wherein said average pore diameter is in the range of about 5 to 15A.

* * * * *